US011027182B2

(12) United States Patent
Mainini et al.

(10) Patent No.: US 11,027,182 B2
(45) Date of Patent: Jun. 8, 2021

(54) SPORTS EQUIPMENT FOR FUNCTIONAL TRAINING

(71) Applicants: Andrea Maria Mainini, Piossasco (IT); Luca Mainini, Milan (IT)

(72) Inventors: Andrea Maria Mainini, Piossasco (IT); Luca Mainini, Milan (IT)

(73) Assignees: Andrea Maria Mainini, Piossasco (IT); Luca Mainini, Milan (IT)

( * ) Notice: Subject to any disclaimer, the term of this patent is extended or adjusted under 35 U.S.C. 154(b) by 0 days.

(21) Appl. No.: 16/325,565

(22) PCT Filed: Apr. 28, 2017

(86) PCT No.: PCT/IB2017/052474

§ 371 (c)(1),
(2) Date: Feb. 14, 2019

(87) PCT Pub. No.: WO2018/051194

PCT Pub. Date: Mar. 22, 2018

(65) Prior Publication Data

US 2019/0184256 A1 Jun. 20, 2019

(30) Foreign Application Priority Data

Sep. 13, 2016 (IT) ..... 202016000091549

(51) Int. Cl.
*A63B 69/00* (2006.01)
*A63B 71/06* (2006.01)
(Continued)

(52) U.S. Cl.
CPC ..... *A63B 69/004* (2013.01); *A63B 15/00* (2013.01); *A63B 21/072* (2013.01);
(Continued)

(58) Field of Classification Search
CPC ..... A63H 33/009; F41B 13/00; F41B 13/02; F41B 13/04; F41B 13/06; F41B 13/08;
(Continued)

(56) References Cited

U.S. PATENT DOCUMENTS 660,962 A 10/1900 Kennedy
5,180,164 A 1/1993 Celaya
(Continued)

FOREIGN PATENT DOCUMENTS

WO WO-2009121071 A2 * 10/2009 ..... A63B 69/004
WO 2016054684 A1 4/2016
WO WO-2016054684 A1 * 4/2016 ..... A63B 21/075

OTHER PUBLICATIONS

Street Smart Self Protection & Weapons—RCI, The Baseball Bat as a Weapon! Urban Survival Free Lesson! [online], Published Apr. 4, 2014, [retrieved on May 7, 2020], Retrieved from the Internet <URL: https://www.youtube.com/watch?v=k0lnFy8-0yM> (Year: 2014).*

(Continued)

*Primary Examiner* — Garrett K Atkinson
*Assistant Examiner* — Zachary T Moore
(74) *Attorney, Agent, or Firm* — Heslin Rothenberg Farley & Mesiti P.C.; Victor A. Cardona, Esq.

(57) ABSTRACT

Sports equipment comprising a handle and at least one stem made of soft and light material fixed and aligned to the handle. The weight of the handle is considerably greater than that of the stem.

14 Claims, 14 Drawing Sheets

(51) Int. Cl.

| | |
|---|---|
| ***A63B 21/075*** | (2006.01) |
| ***A63B 23/035*** | (2006.01) |
| ***A63B 60/24*** | (2015.01) |
| ***A63B 23/12*** | (2006.01) |
| ***A63B 21/072*** | (2006.01) |
| ***A63B 15/00*** | (2006.01) |

(52) U.S. Cl.
CPC ..... *A63B 21/075* (2013.01); *A63B 23/03508* (2013.01); *A63B 23/1209* (2013.01); *A63B 60/24* (2015.10); *A63B 69/00* (2013.01); *A63B 71/06* (2013.01); *A63B 71/0622* (2013.01); *A63B 23/03525* (2013.01); *A63B 2069/0044* (2013.01); *A63B 2220/17* (2013.01); *A63B 2220/30* (2013.01); *A63B 2220/40* (2013.01); *A63B 2220/53* (2013.01); *A63B 2220/833* (2013.01); *A63B 2225/50* (2013.01); *A63B 2225/62* (2013.01); *A63B 2230/75* (2013.01)

(58) Field of Classification Search
CPC . F41B 13/10; A63B 5/06; A63B 15/00; A63B 15/005; A63B 15/02; A63B 21/06; A63B 21/0601; A63B 21/0602; A63B 21/0603; A63B 21/0604; A63B 21/0605; A63B 21/0606; A63B 21/0607; A63B 21/072; A63B 21/0722; A63B 21/0724; A63B 21/0726; A63B 21/0728; A63B 21/075; A63B 21/08; A63B 21/28; A63B 21/285; A63B 21/40; A63B 21/4023; A63B 21/4033; A63B 21/4035; A63B 22/0002; A63B 23/035; A63B 23/03508; A63B 23/03516; A63B 23/0355; A63B 23/12; A63B 23/1209; A63B 23/1245; A63B 23/1281; A63B 23/14; A63B 23/16; A63B 53/10; A63B 53/12; A63B 53/14; A63B 59/00; A63B 59/40; A63B 59/42; A63B 59/48; A63B 59/50; A63B 59/51; A63B 59/52; A63B 59/54; A63B 59/55; A63B 59/56; A63B 59/58; A63B 59/581; A63B 59/60; A63B 59/70; A63B 59/80; A63B 69/004; A63B 69/02; A63B 2069/044; A63B 2244/16; A63B 2244/17
See application file for complete search history.

(56) References Cited

U.S. PATENT DOCUMENTS

| | | | | |
|---|---|---|---|---|
| 6,036,602 | A * | 3/2000 | Abbott | A63B 69/004 463/47.2 |
| 8,187,124 | B2 * | 5/2012 | Ciesar | A63B 60/16 473/457 |
| 8,827,846 | B2 * | 9/2014 | Shocklee | A63B 60/08 473/453 |
| 9,623,276 | B1 * | 4/2017 | Deras | A63B 21/0724 |
| 2002/0037759 | A1 | 3/2002 | Aldridge | |
| 2003/0114257 | A1 * | 6/2003 | Mabry | A63B 69/0002 473/457 |
| 2004/0127292 | A1 * | 7/2004 | Chan | F41B 13/02 463/47.2 |
| 2004/0162003 | A1 * | 8/2004 | Vanaver | A63H 33/009 446/473 |
| 2006/0025246 | A1 * | 2/2006 | Forney | A63B 60/16 473/457 |
| 2006/0199676 | A1 * | 9/2006 | Ashbaugh | A63B 69/0071 473/448 |
| 2007/0111636 | A1 | 5/2007 | Hatherley | |
| 2008/0202317 | A1 * | 8/2008 | Capotosto | A63B 21/0004 84/422.4 |
| 2011/0152044 | A1 * | 6/2011 | Klein | A63B 21/4043 482/110 |
| 2012/0214622 | A1 * | 8/2012 | Rockhill | A63B 69/0002 473/457 |
| 2017/0120100 | A1 * | 5/2017 | Smith | A63B 21/026 |

OTHER PUBLICATIONS

Contender, Fight Sports Punch Shield [online], Published Feb. 24, 2012, [retrieved on May 7, 2020], Retrieved from the Internet <URL: https://www.amazon.com/Contender-Fight-Sports-Punch-Shield/dp/B006CUCG5Y/ref=psdc_3415071_t3_B06XFPFHPL> (Year: 2012).*

Forged Foam, Glaive, Published: Jun. 26, 2015, Retrieved from the Internet <URL: https://web.archive.org/web/20150626173712/http://www.forgedfoam.com/?product=glaive> (Year: 2015).*

International Search Report and Written Opinion of the International Searching Authority for PCT/IB2017/052474 dated Aug. 1, 2017.

* cited by examiner

SPORTS EQUIPMENT FOR FUNCTIONAL TRAINING

CROSS REFERENCE TO RELATED APPLICATIONS

This application is a national stage filing under section 371 of International Application No. PCT/IB2017/052474, filed on Apr. 28, 2017, published in English on Mar. 22, 2018 as WO2018/051194A1, and claims priority to Italian Application No. 202016000091549, filed on Sep. 13, 2016. The entire disclosures of each application are hereby incorporated herein by reference.

FIELD OF THE INVENTION

The present invention is related to a sports equipment of the type including a handle to which a stem is fixed.

STATE OF THE PRIOR ART

Foil, swords and sabres are known in the art as sports equipments used in competition between two contenders. Such equipments are normally light so as to enable a quick and accurate movement: their weigh is usually comprised between 500 and 700 grams distributed in an almost balanced fashion between the handle and the stem.

U.S. Pat. No. 660,692 shows a dump-bell which, in a use configuration, has a handling part from which a rigid threaded stem projects. The handle can be used as a conventional dump-bell or as a club for juggling exercises.

U.S. Pat. No. 5,180,164 discloses a light police baton with a handle to which a stick made up of a light rattan core is fixed. The baton is intended to be used by law enforcement officers to deliver minor damages to the ill-intentioned thanks to its overall lightness.

There arises the need for a sports equipment capable of enabling training individually or in pairs based on simulation of the typical moves in a sword and shield battle though entirely harmless and with a weight high enough to enable efficient muscle building.

SUMMARY OF THE INVENTION

The object of the invention is to provide a sports equipment thus made.

According to the invention, this purpose is attained thanks to a sports equipment according to claim 1, i.e. comprising a handle having a first end and a second end, at least one stem made of soft and light material aligned to said handle and fixed at the first end, and in which the weight of the handle is considerably greater than that of the stem.

In addition, the invention provides for a sports kit made up of the sports equipment used alongside a shield which comprises a disc-shaped structure having an inner face to which a handle is fixed and an outer face provided with a soft material lining, in which the disc-shaped structure is suitable to fixedly or removably house one or more variable weight elements.

A sports training method in which the sports equipment and the shield can be used simultaneously is also described.

In particular, using the sports equipment and/or the shield according to the invention enables performing a sports activity aimed at making countless more or less complex movements (or combinations of movements), individually, in pairs or in groups, thanks to the greater weight of the handle of the equipment and the structure of the shield (if provided), performing a physical training exercise for building up muscles and simultaneously, thanks to the soft and light stem of the sports equipment, making the action against an object (or person) entirely harmless.

BRIEF DESCRIPTION OF THE DRAWINGS

The invention will now be described in detail, purely by way of non-limiting example, with reference to the attached drawings, wherein.

DETAILED DESCRIPTION OF THE INVENTION

Figure 1:
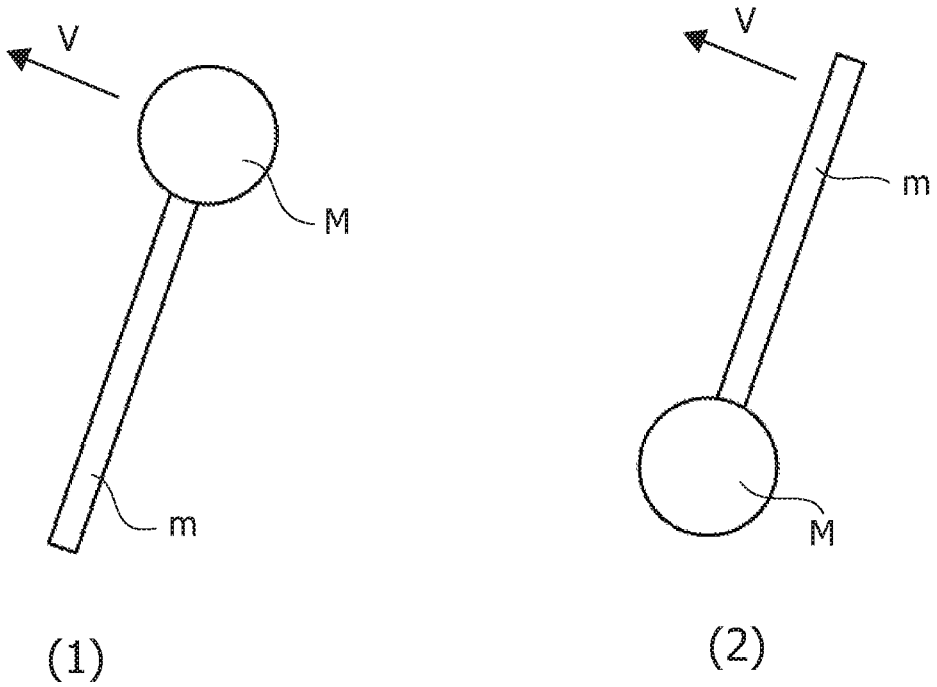
FIG. 1 schematically shows the distribution of the masses in a conventional equipment (FIG. 1.1) and in one according to the invention (FIG. 1.2)

FIG. 1 shows the principles of the invention with reference to an elementary object made up of an extended stem and a head in two different use configurations. In particular, the distribution of masses in the two different configurations with respect to the part in which the object is held by a user, are represented schematically. In FIG. 1.1 the mass stem m serves as a handle and the mass head M is moved at speed v. In FIG. 1.2 the mass stem m is moved at speed v and the mass head M serves as a handle. In cases where the mass M of the head is considerably greater than the mass of the stem (i.e. M>>m), the amount of motion $P_1$=Mv associated to the mass head M of the object in the use configuration of FIG. 1.1 will be considerably greater than the amount of motion $p_2$=mv associated to the mass stem m of the object in the use configuration of FIG. 1.2; i.e. $P_1 >> p_2$. This implies that an object impacted by the head M moving at speed v would receive a stress (force) considerably greater than the stress exerted by the mass stem m which moves at the same speed v. Vice versa, an object impacted by the mass stem m moving at speed v would receive a stress (force) considerably lower than the stress exerted by the mass head M which moves at the same speed v.

Figure 2:
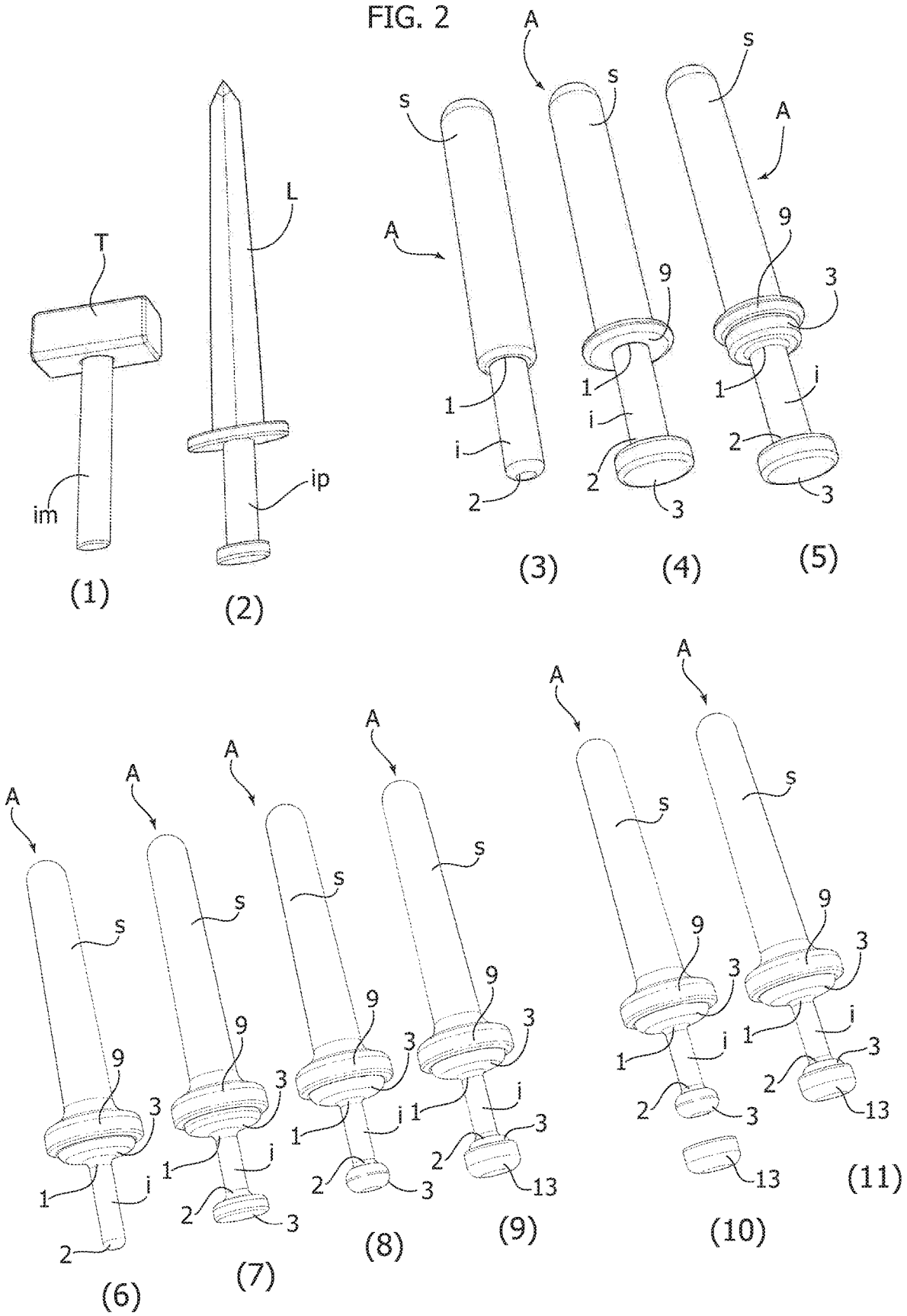
FIG. 2 shows a conventionally known tool (FIG. 2.1) and sports equipment (FIG. 2.2) and some embodiments of the invention (FIGS. 2.3-2.11)

FIG. 2 illustrates a conventional hammer (FIG. 2.1) and a conventional sword (FIGS. 2.2) and three embodiments of the invention (FIGS. 2.3, 2.4, 2.5) with the aim of revealing the physics principle described with reference to FIG. 1.

The hammer illustrated in FIG. 2.1 has a head T with considerably greater mass with respect to the handle im.

Also the sword in FIG. 2.2 has a blade L with a considerably greater mass with respect to the handle ip. With the aim of optimising the purpose that these objects were designed for, it is actually preferable that the amount of motion transmitted to the object to be impacted by means of the opposite end with respect to handle be the greatest possible (same principle also applying to a baseball bat, golf club or the like).

On the contrary, the article of the example illustrated in FIG. 1.2 refers to a sports equipment A according to the invention, which is shown in some embodiments thereof in FIGS. 2.3-2.11 in which the equipment A has a handle i having a considerably greater mass than the mass of the stem s. Thus, the amount of motion transmitted to the object or person hit by the stem s is reduced to the minimum and, at the same time, due to the heavy handle i, a user may perform a considerable physical exercise suitable to build muscles and improve strength, resistance and coordination physical performance.

In an embodiment, the weight of said handle i is one order of magnitude greater than that of the stem s.

With reference to the centre of mass of the sports equipment A according to the invention, it is at a point comprised between the first end 1 and the second end 2 of the handle i.

The heavy handle i is designed to enable a comfortable and firm grip with one hand or, in an embodiment, with two hands. In addition, it can be variously shaped: in FIG. 2.3 the handle i is shaped to form a constant radius cylinder, while in FIGS. 2.4, 2.5, 2.6 and 2.7 it has one or two disc-shaped elements or flanges 3 projecting from one or both ends 1, 2. Like in the weight-lifting handles, the projecting disc-shaped elements 3 have the double function of increasing the weight of the element on which they are mounted and protecting the hand when the element is placed on the ground. In order to make gripping further harmless in case of impact, in FIG. 2.8 the flange projecting from the end 2 is shaped without edges and in FIGS. 2.10 and 2.11 the end 2 is provided with a soft lining 13. The diameter of the handle i is comprised between 10 and 60 mm, more preferably approximately between 30 and 40 mm. The weight of the handle i may be comprised approximately between 1 kg and 10 kg.

The stem s is designed to be as light as possible, so that the amount of motion transmitted during an impact is minimum. In addition, it is made of soft material, so that the force resulting from the impact is minimised further. An example of material suitable for constructing the stem is XL EXTRALIGHT®, a closed-cell expanded material sold in Italy by Finproject S.p.A. Thanks to these characteristics, the action of the sports equipment A on an hit object or person will be of low impact and thus entirely harmless.

In the preferred embodiment, the stem s, in the area for coupling with the handle, has a protection-like flange 9 covered with soft material to partly protect the hand of a user and prevent the hit object or person from impacting against a part made of hard material.

The length of the stem s is approximately comprised between 20 and 100 cm, more preferably between 30 and 80 cm; as mentioned, the weight of the stem s is considerably lesser than that of the handle i and preferably lesser than 1 Kg approximately. The heavy handle i and the light stem s are aligned on the same axis and are integrally mutually joined so as not to disengage during use. In some embodiments, the engagement between the stem s and the handle i is permanent, while it is releasable in others so as to enable disassembly thereof.

In an embodiment, the stem s is constituted by an inflatable bladder.

Figure 3:
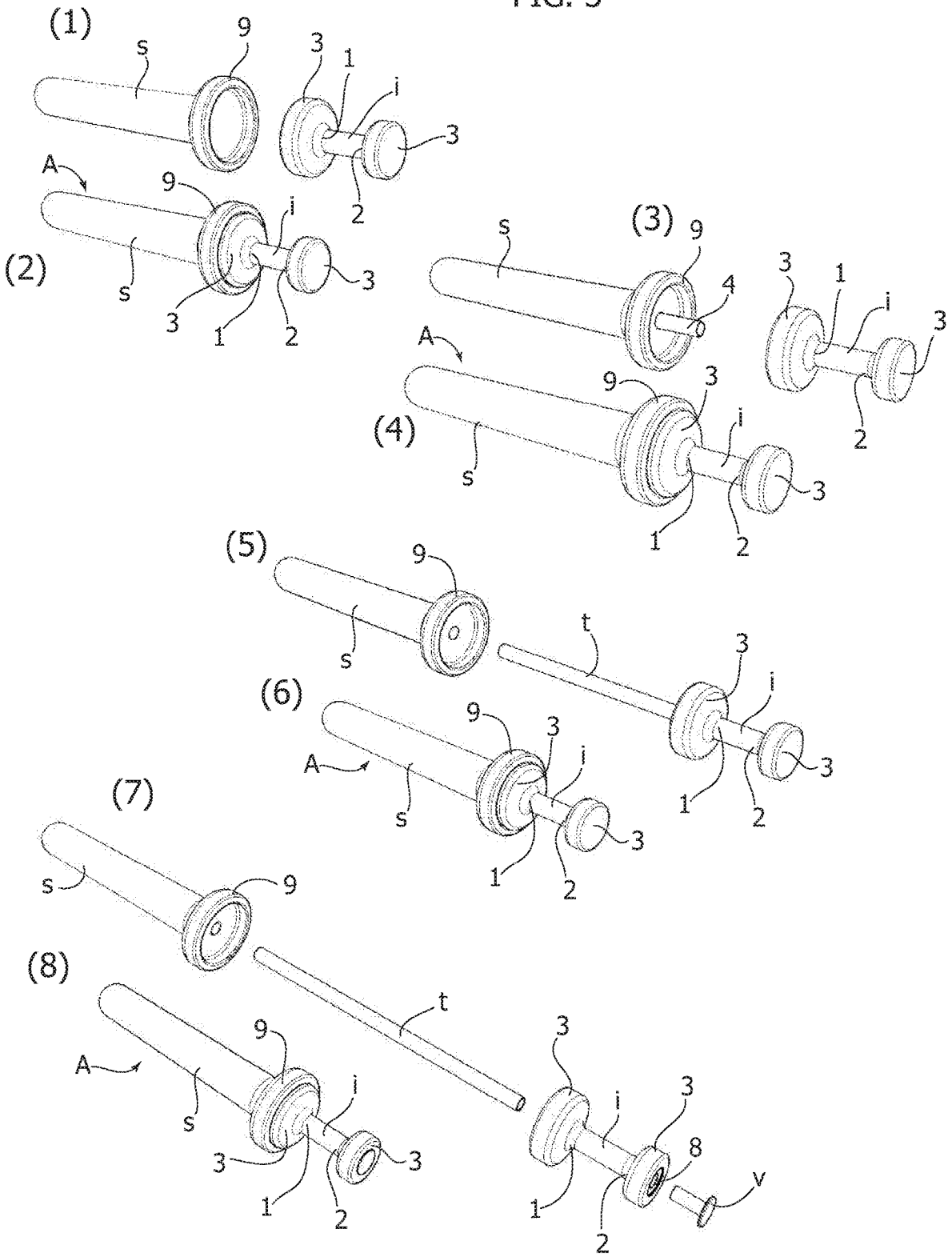
FIGS. 3 to 5 show some possible embodiments of the sports equipment according to the invention.

FIG. 3 shows some embodiments of the equipment A according to the invention.

In FIG. 3.1, the fixing of the stem s on the handle i is obtained by gluing or coupling so as to obtain the assembled equipment A of FIG. 3.2;

in FIG. 3.3 the stem is provided with an inner stiffening core 4 that can be coupled to the handle i by means of screws or coupling so as to obtain the assembled equipment A of FIG. 3.4;

in FIG. 3.5 the handle i is provided with a pipe t projecting from the first end 1 thereof and couplable to the stem s by means of gluing or coupling so as to obtain the assembly A of FIG. 3.6;

FIG. 3.7 shows an exploded view of an embodiment according to the invention in which the pipe t is suitable to be partly introduced and locked by gluing or coupling in the stem s. A hollow cylindrical handle i, provided with an end flange 3, is provided with a coaxial through hole 8 within which the portion of the pipe t projecting from the stem s can be inserted. Screw-like fastening members v are designed to fix the end of the portion of the pipe t projecting from the stem s to the second end 2 of the handle 1 so as to obtain the assembly A of FIG. 3.8.

In the embodiments shown in FIG. 3 the handle can be constituted by a cylinder made of plastic and/or rubber material with end flanges 3 within which one or more suitably calibrated weights (for example made of iron or lead) can be permanently or removably housed. Alternatively, the handle i and the flange 3 can be made of one or more heavy materials (for example iron or lead) and be partly or fully covered by soft material.

Figure 4:
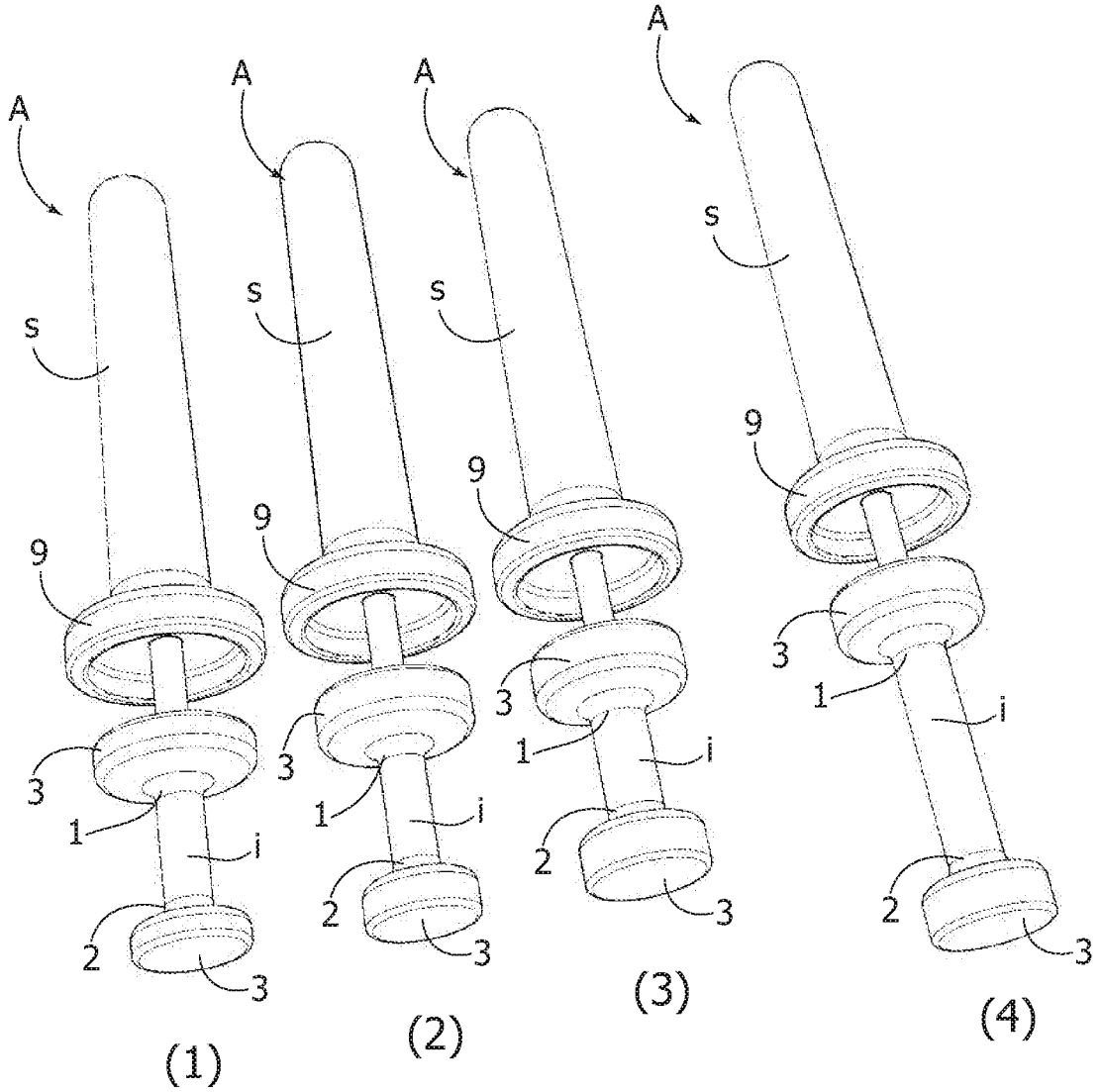

FIG. 4 shows some possible variants of the handle i of the equipment A according to the invention.

In FIGS. 4.1, 4.2 and 4.3, the handles i have respectively increasing dimensions and weights;

in FIG. 4.4 the handle i is extended to enable a 2-handed use.

Figure 5:
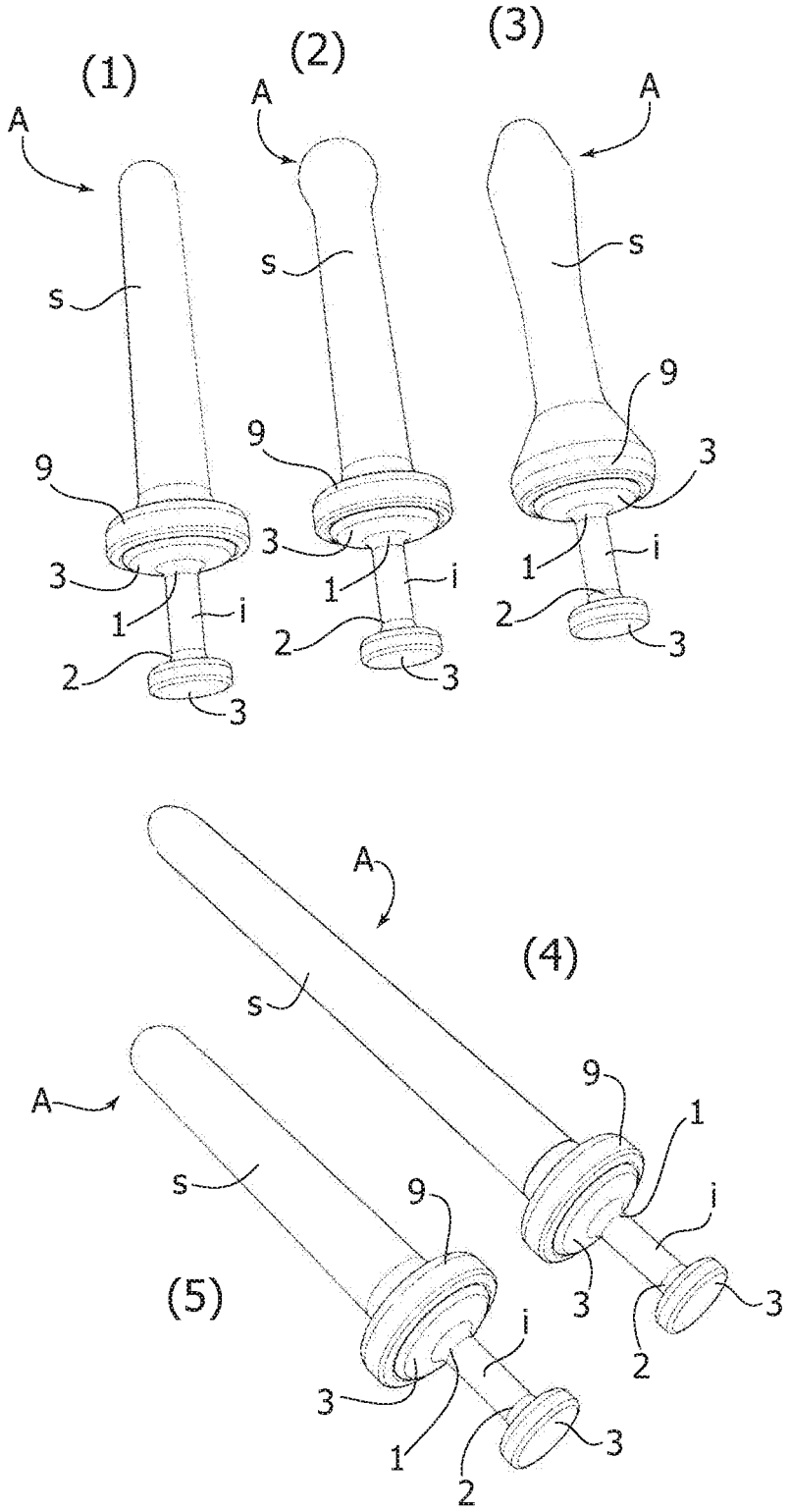

FIG. 5 shows some possible variants of the stem s of the equipment A according to the invention:

in FIGS. 5.1, 5.2 and 5.3, the stem s has a variable diameter section in the area for coupling with the handle i and/or in the opposite end;

in FIGS. 5.4 and 5.5 the stems s have similar shapes and different lengths.

Figure 6:
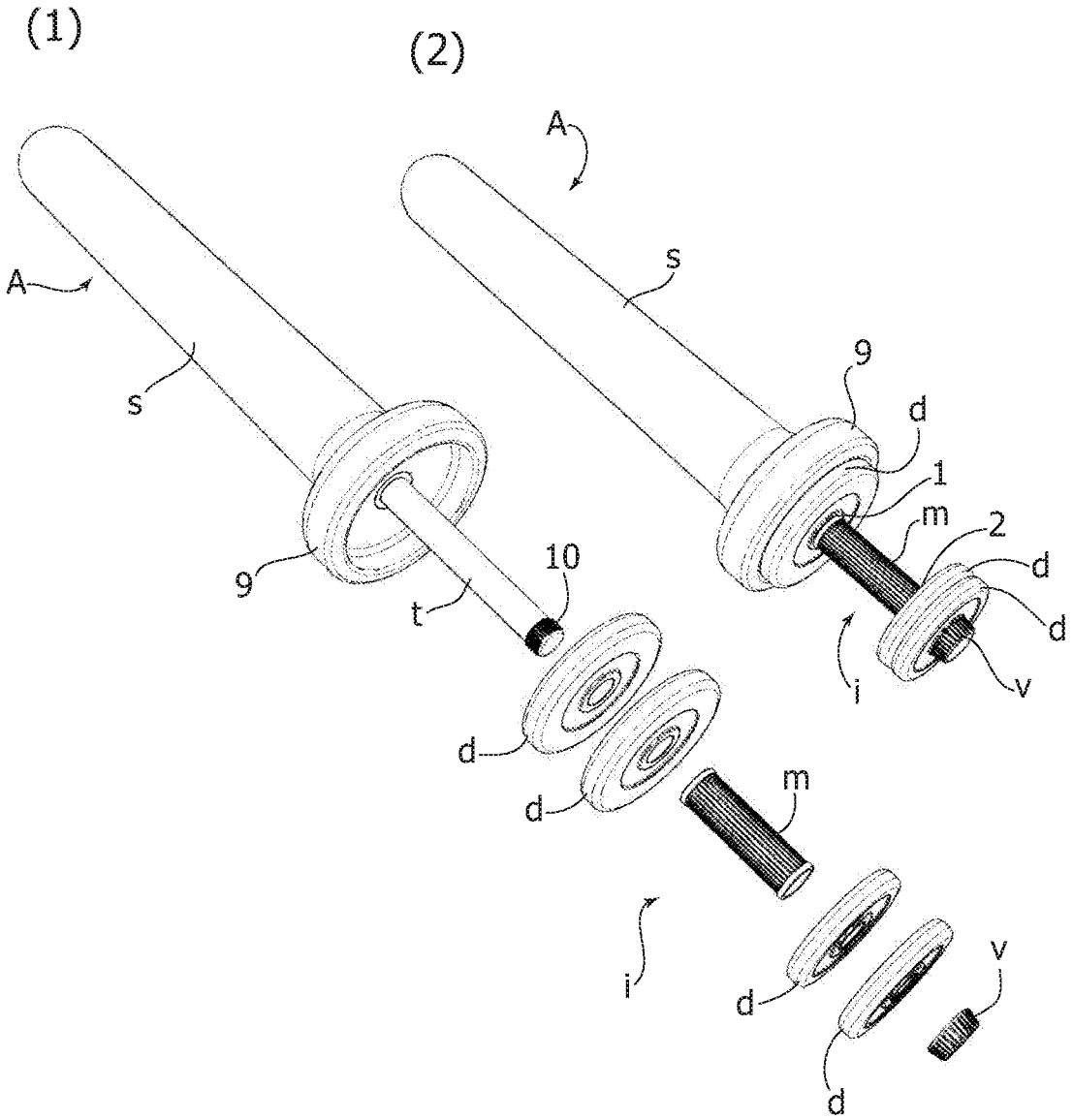
FIG. 6 shows an embodiment of the equipment providing for a modular solution for applying gym weights to the handle.

FIG. 6 shows an embodiment of the equipment A according to the invention which enables obtaining a disassemblable modular solution to enable quick assembly and disassembly of one or more commonly known gym weights d.

FIG. 6.1 shows an exploded view of the entirety of the components. The stem s is designed with an annular flange 9 in the end for coupling with the handle i. The handle i comprises a tubular section t which is coupled to the stem in a first end thereof by means of gluing and/or coupling, and it is provided with a thread 10 in the opposite end thereof. The following are engaged on the pipe t in the following order: two gym weights d to be arranged abutting against the flange of the stem 9, a hollow cylindrical knob m which also serves as a spacer between the weights d, two further gym weights d and a threaded ring nut v that can be engaged in the thread 10 and suitable to firmly lock the weights d and the knob m on the pipe t;

FIG. 6.2 shows the end result with the assembly A.

A man skilled in the art will clearly observe that, in order to change the overall weight of the equipment A enabling a user to train in variously demanding conditions, the number, size and material the gym weights d are made of can be unlimitedly varied still remain within the scope of the invention.

Figure 7:
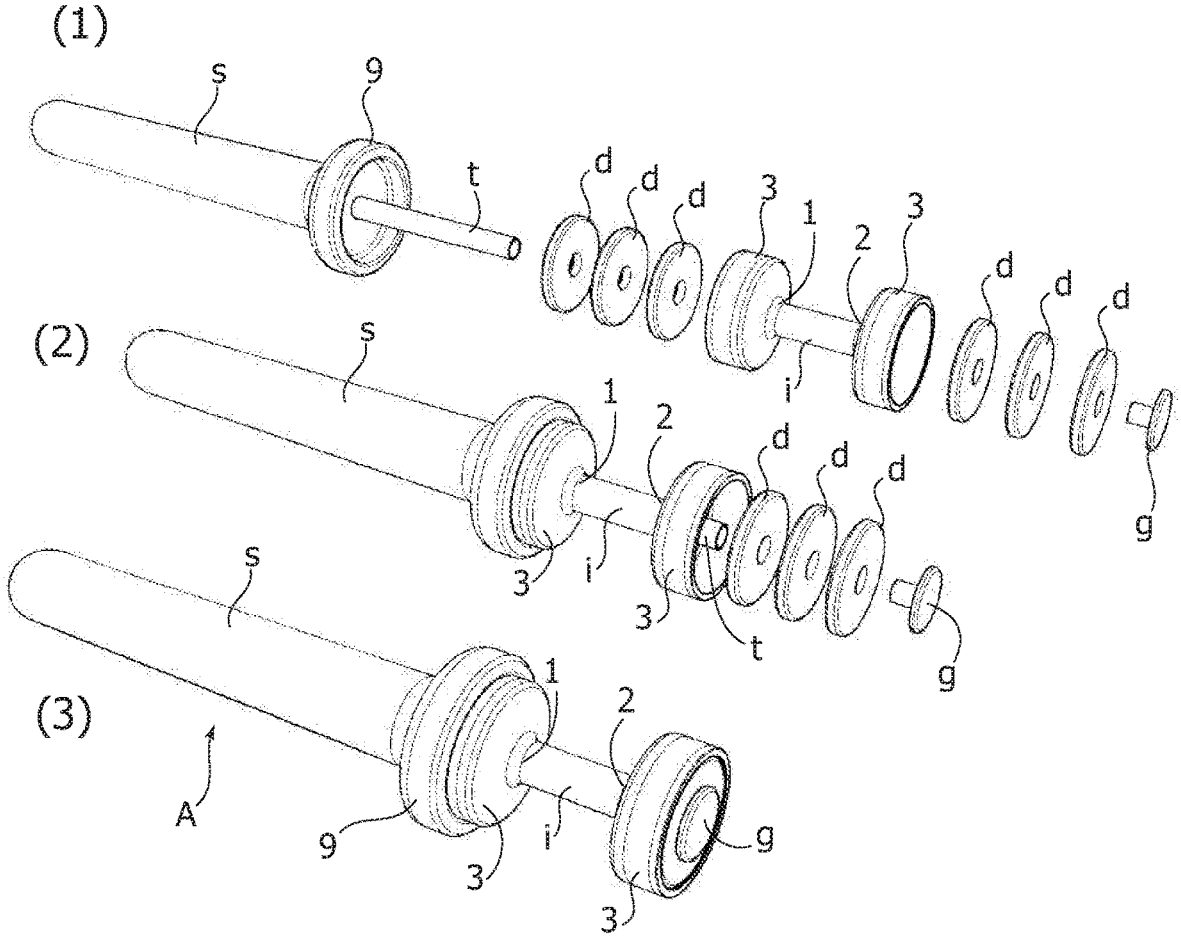
FIG. 7 shows a variant of the sports equipment of FIG. 6.

FIG. 7 shows an embodiment of the equipment A according to the invention similar to the one described in FIG. 6. In this case, the hollow knob m includes, at each of the ends thereof, two flanges 3 in which weights d of different dimensions and/or materials can be housed.

FIG. 7.1 shows an exploded view of the components used in this embodiment.

FIG. 7.2 shows, in partially exploded view, an intermediate assembly condition in which three weights d abut against the end flange 9 of the stem s and they are housed in the corresponding end flange 3 of the handle i. Other three weights d can once again be engaged on the pipe t, housed in the end flange 3 and fastened using the ring nut g.

FIG. 7.3 shows the end result with the assembly A.

Even in this case, the number and amount of weights d used may vary unlimitedly.

Figure 8:
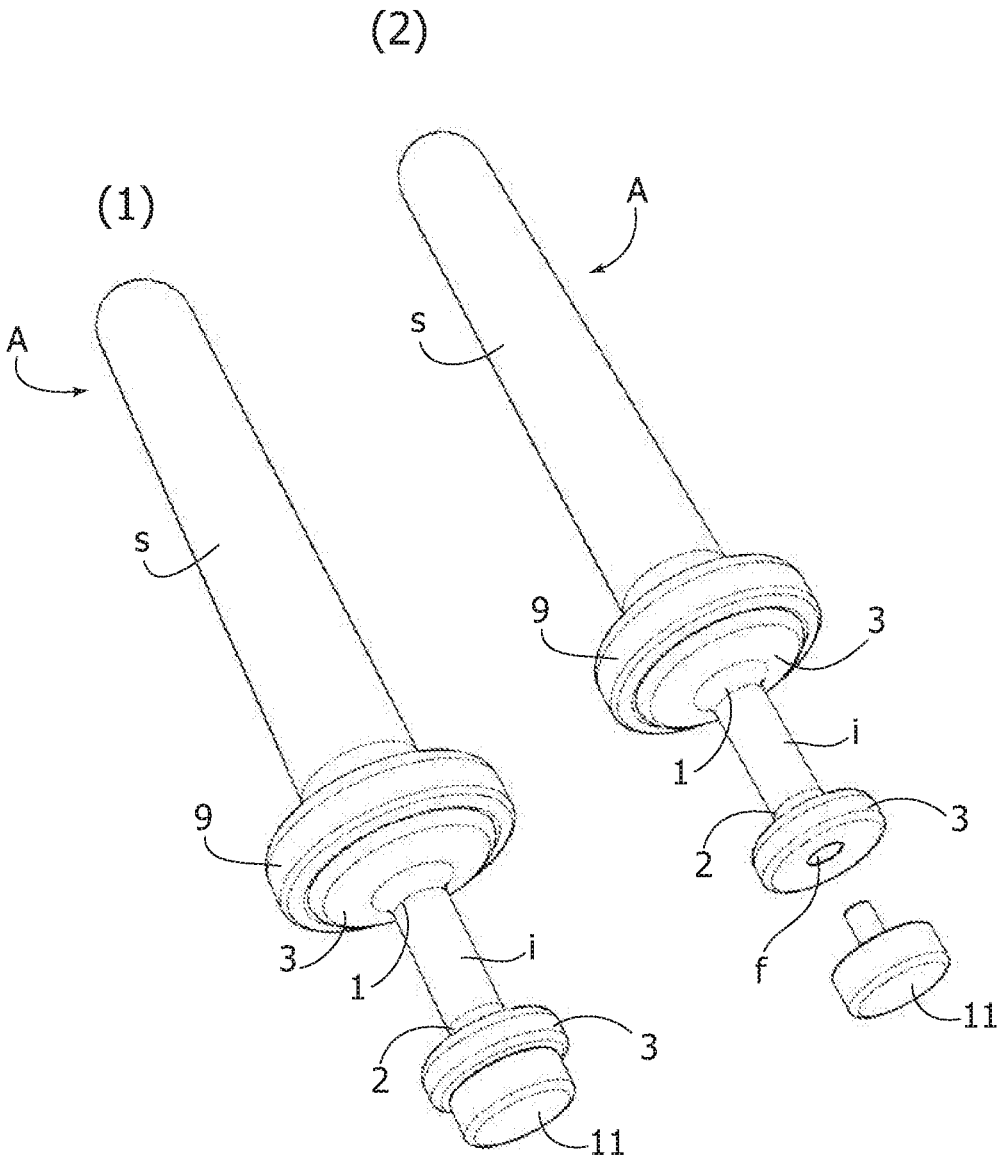
FIG. 8 shows an embodiment of the equipment that enables adding weights on the second end of the handle.

FIG. 8 shows a further embodiment of the equipment A according to the invention. FIG. 8.1 shows a cylindrical-shaped weight 11 that can be fixed at a hole f provided on the second end 2 of the handle i by means of a screw or coupling system.

FIG. 8.2 shows the end result with the assembly A.

The weight 11 may vary in terms of shape and material to enable simply and practically modifying the overall weight of the sports equipment A.

Figure 9:
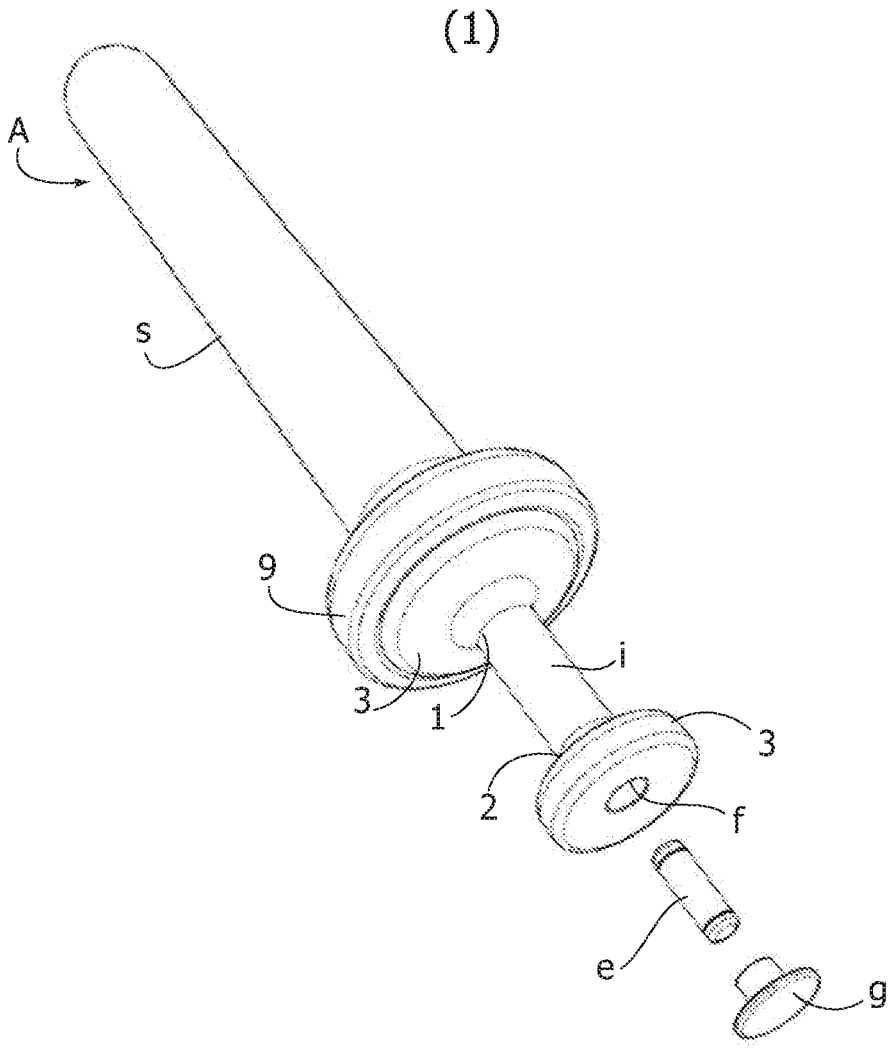
FIG. 9 shows an exploded view of an embodiment of the sports equipment according to the invention, comprising an electronic module provided with sensors and means for the remote transmission of the data detected by the sensors.

FIG. 9 shows an embodiment of the equipment A according to the invention which enables housing an electronic module provided with sensors for measuring the performance level during training. Such sensors, not described in detail in that within the reach of the man skilled in the art, are suitable to calculate acceleration, speed, delivered shots and the calories used by a user during a training session. Furthermore, Wi-Fi or Bluetooth means for the remote transmission of the data detected by the sensors to an external receiver device (for example a smartphone or tablets, not shown) on which there can be operated a specific application for processing and displaying such data, are also provided for. The electronic module e can be inserted into a hole f of the handle i and be locked by means of a ring nut g. Alternatively, the electronic module can be housed outside the handle.

Figure 10:
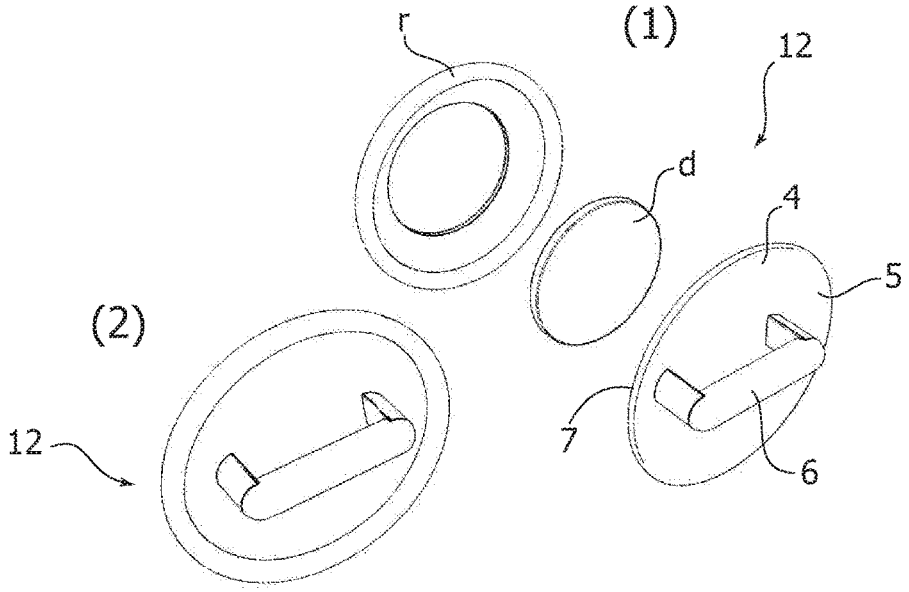
FIG. 10 shows a shield of a kit according to the invention.

FIG. 10 shows a shield 12 which forms a sports kit according to the invention alongside the previously described equipment A.

FIG. 10.1 shows an exploded view of the elements that form the shield 12. The shield 12 comprises a disc-shaped structure 4 having an inner face 5 to which a handle 6 and an outer face 7 provided with a soft material lining, is fixed. The disc-shaped structure 4 is suitable to fixedly or removably house one or more variable weight elements d.

FIG. 10.2 shows the end result with the assembly 12.

Figure 11:
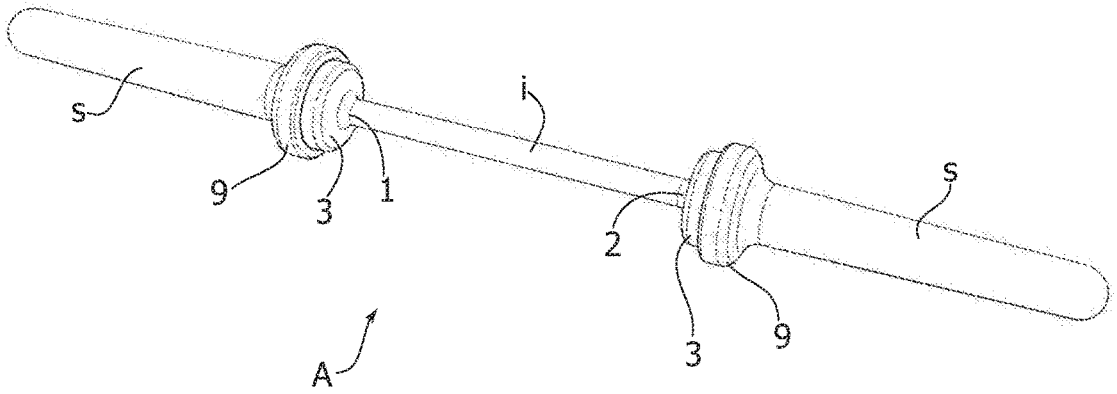
FIG. 11 shows a sports equipment provided with two stems according to a variant of the invention.

FIG. 11 shows a variant of the equipment A according to the invention provided with two juxtaposed stems s, s. A respective stem s is connected to each end 1, 2 of the handle i as described in any of the previous embodiments.

Figure 12:
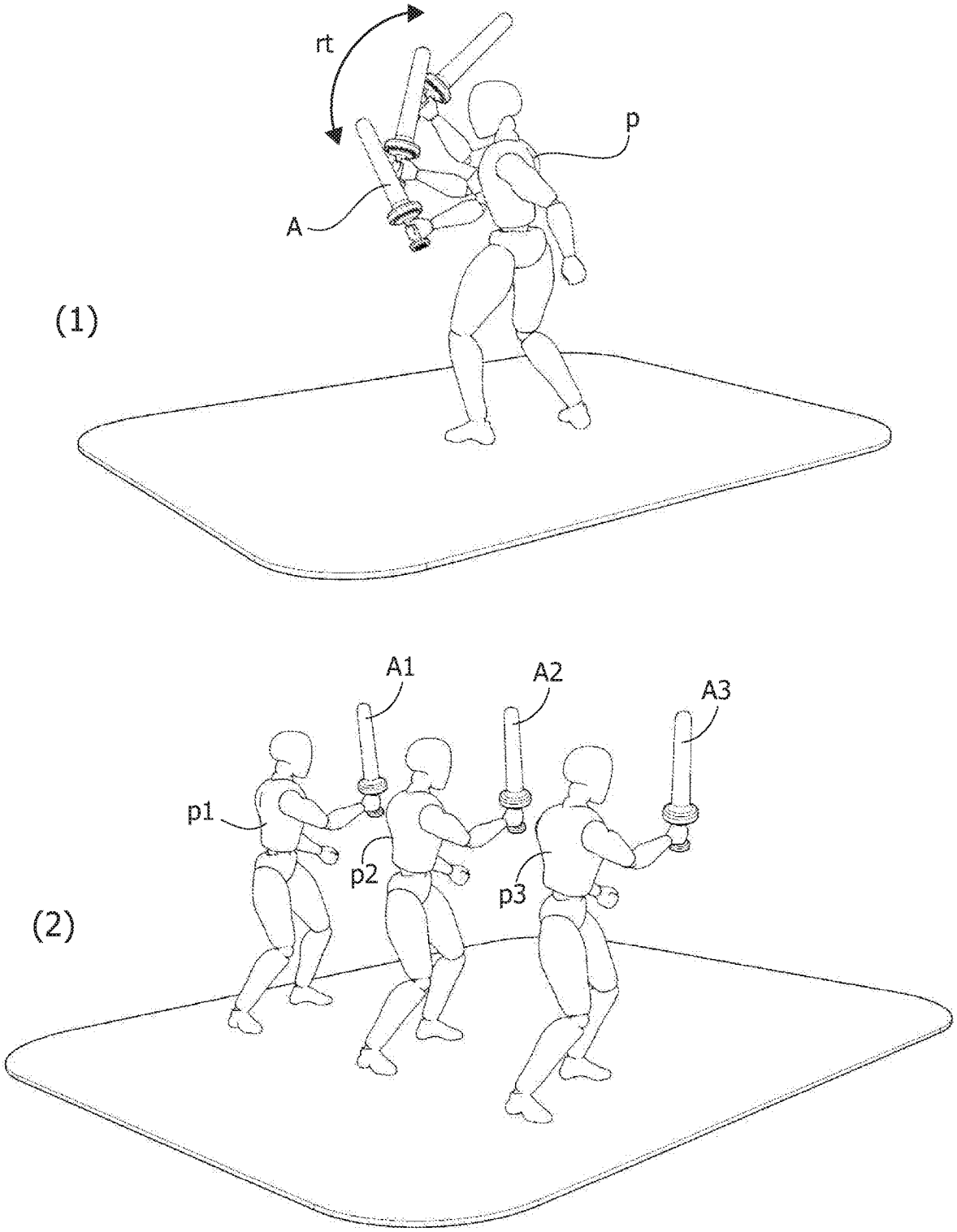
FIGS. 12 to 14 show possible examples of use of the sports equipment according to the invention.

FIG. 12 shows a potential example of use of the equipment according to the invention.

In particular, FIG. 12.1 shows a person p gripping the equipment A and training following roto-translational movements schematised by the double arrow rt; there are countless possible movements for simulating the conditions typical of a sword battle; training can be carried out by repeating the movements (or combinations of movements) in subsequent series that provide for various repetitions; training can be carried out with or without music.

FIG. 12.2 shows several people p1, p2, p3 respectively gripping the sports equipment A1, A2, A3 and training executing-together and in a coordinated fashion-several types of movements like in the case of FIG. 12.1.

Figure 13:
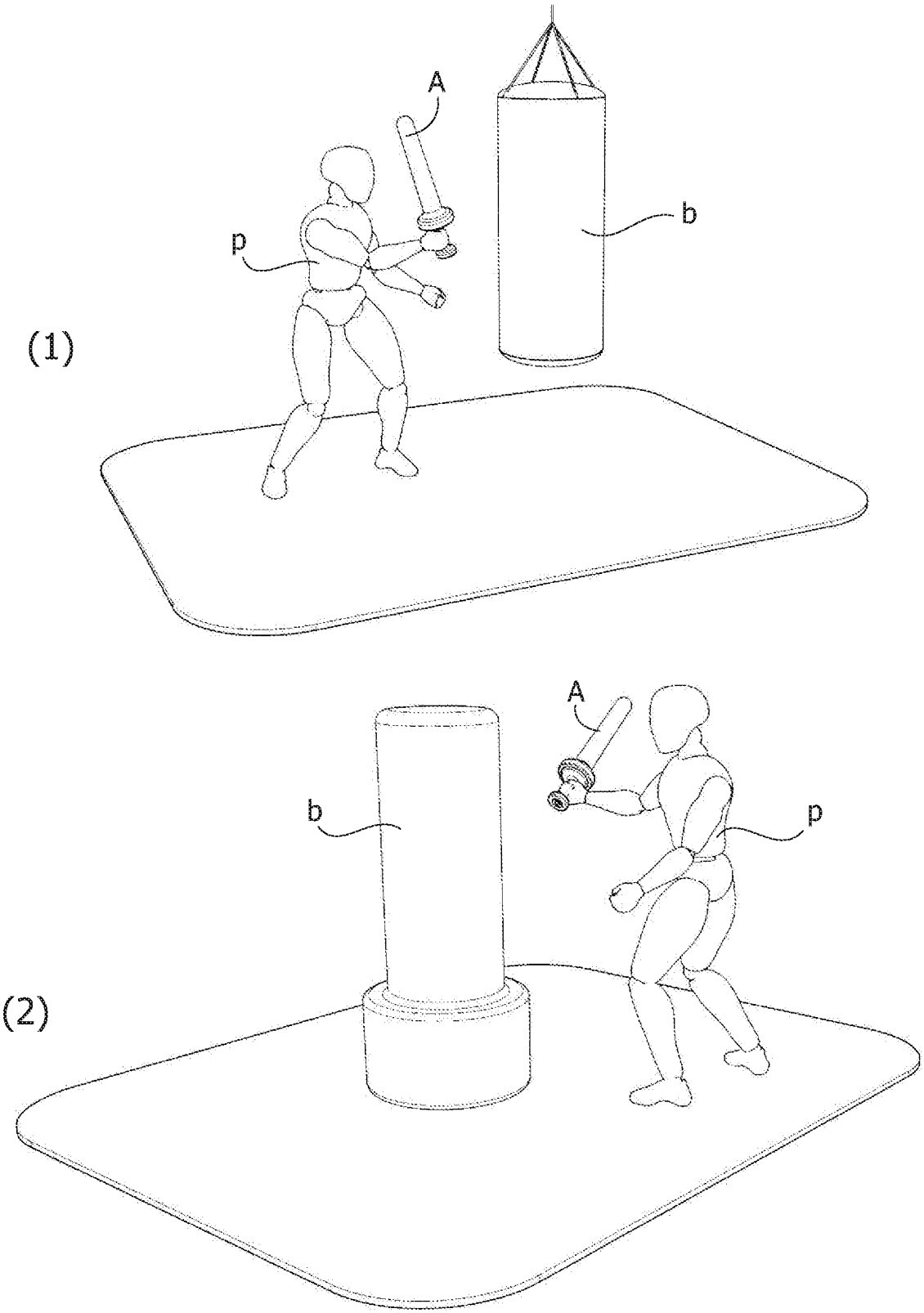

FIG. 13 shows a potential example of application of the equipment according to the invention.

FIG. 13.1 shows a person p gripping the equipment A and training hitting a punching bag b hanged on the ceiling;

FIG. 13.2 shows a person p gripping the equipment A and training hitting a punching bag b placed on the ground.

Figure 14:
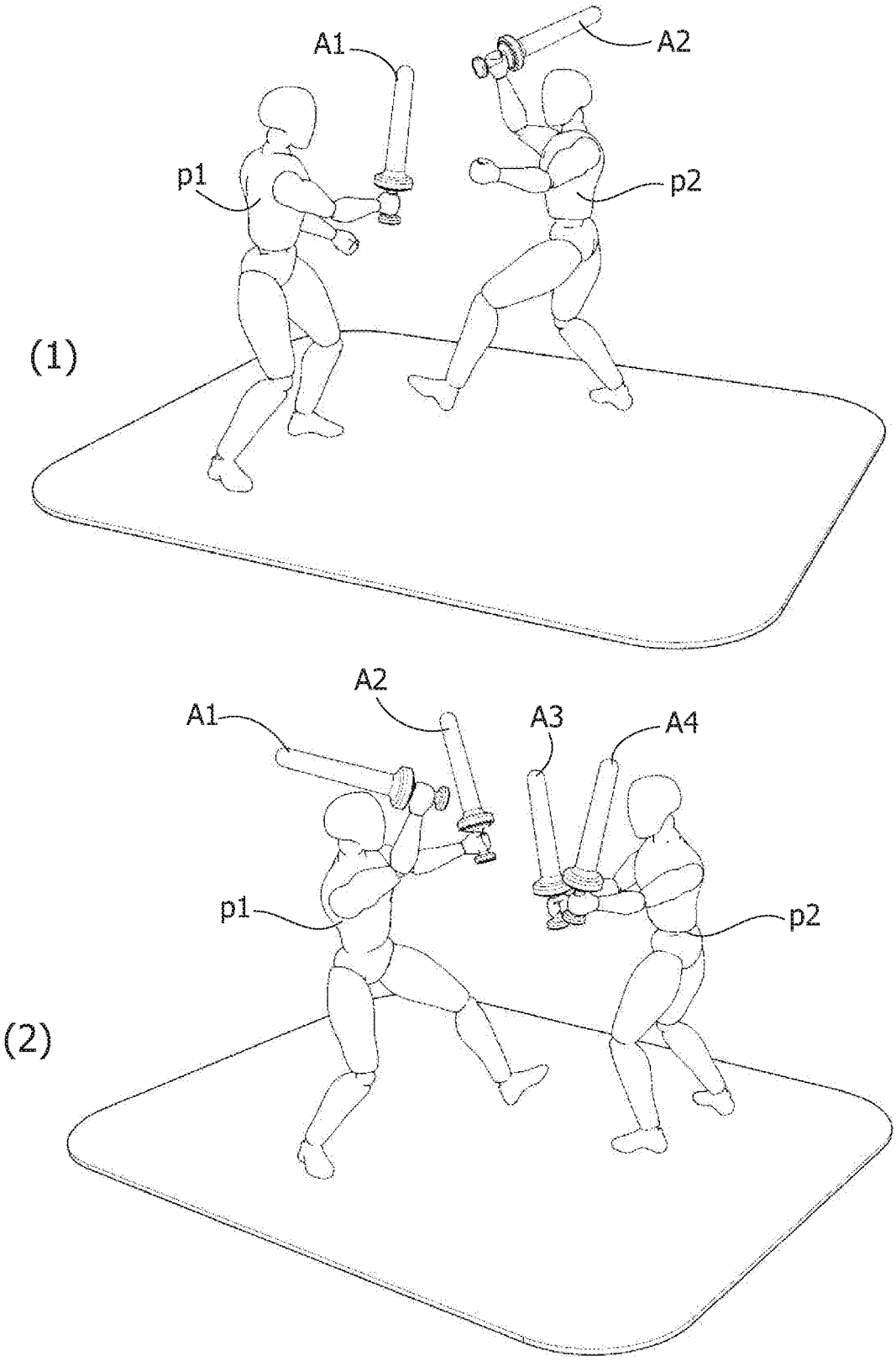

FIG. 14 shows a potential example of use of the equipment A according to the invention.

FIG. 14.1 shows two people p1 and p2, respectively gripping the sports equipment A1 and A2, training simulating moves similar to a sword battle.

FIG. 14.2 shows two people p1 and p2, gripping two sports equipment respectively A1-A2 and A3-A4, training simulating moves similar to a sword battle.

Figure 15:
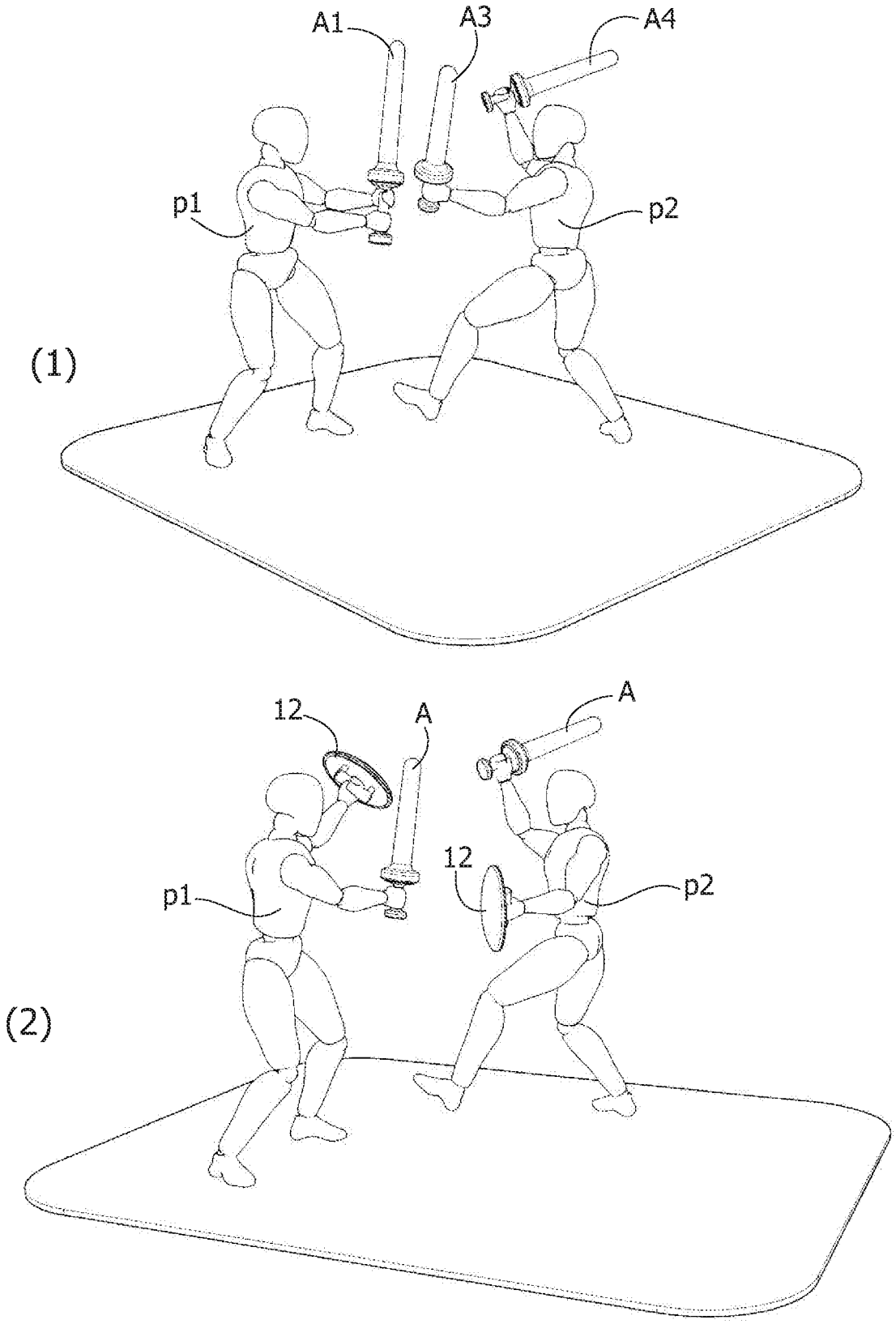
FIG. 15 shows a potential use of the sports kit made up of the equipment and the shield according to the invention.

FIG. 15 shows a potential example of application and use of the sports kit according to the invention.

FIG. 15.1 shows a person p1 gripping an equipment having a handle with two hands A1 and training with a person p2 gripping two equipments A3-A4, simulating moves typical of a sword battle;

FIG. 15.2 shows two people p1 and p2, respectively gripping an equipment A1 and a shield 12 training simulating moves similar to a sword and shield battle.

Obviously, the details and embodiments of the equipment and sports kit according to the invention may widely vary with respect to what has been described and illustrated by way of example, without departing from the scope of protection of the present invention as defined in the claims that follow.

The invention claimed is:

1. Sports equipment for use in simulating moves typical of a sword battle comprising:

a handle having a first end formed as a first flange, and a second end formed as a second flange, said first flange and said second flange increasing a weight of said handle and protecting a hand of a user;

at least one stem having a proximal end connected to said first end and a distal end opposite said first end relative to a longitudinal dimension of said at least one stem, said distal end being free and connected directly to said handle only by said proximal end;

said at least one stem comprises an inner stiffening core an outer body receiving said core in an interior cavity thereof, said outer body made of a light and soft closed-cell expanded material, such that when said outer body makes an action against an object or person the action is entirely harmless;

wherein the weight of said handle is greater than that of said at least one stem, the weight of said handle being between 1 and 10 kg and the weight of said at least one stem being less than 1 Kg;

wherein a center of mass of said sports equipment is at a point located between the first end of said handle and the second end of said handle.

2. Sports equipment according to claim 1, wherein the weight of said handle is one order of magnitude greater than that of said stem.

3. Sports equipment according to claim 1, wherein said handle is designed to removably receive one or more variable weight elements.

4. Sports equipment according to claim 1, wherein a first weight and a second weight are removable from the handle.

5. Sports equipment according to claim 1, wherein said handle has a length sufficient to enable gripping with two hands.

6. Sports equipment according to claim 1, wherein said handle has an ergonomic shape.

7. Sports equipment according to claim 1, wherein said second flange projecting from said second end is provided with a soft lining.

8. Sports equipment according to claim 1, wherein said stem has an overall length between 30 and 80 cm.

9. Sports equipment according to claim 1, wherein said stem has a circular-shaped, square-shaped or polygonal-shaped cross-section.

10. Sports equipment according to claim 9, wherein said stem is tapered along a longitudinal axis thereof.

11. Sports equipment according to claim 1, wherein a coupling between the stem and the handle can be disengaged.

12. Sports equipment according to claim 1, further comprising:

an electronic module provided with sensors for detecting at least one from among acceleration, speed, shots delivered and calories used by a user; and wireless means for transmitting such detected data to an external receiver device for processing and display thereof.

13. Sports equipment according to claim 1, wherein said at least one stem comprises two juxtaposed stems fixed to the handle.

14. Sports kit comprising the sports equipment according to claim 1, and a shield comprising a disc-shaped structure having an inner face to which a shield handle is fixed and an outer face provided with a soft material lining in which the disc-shaped structure is suitable to fixedly or removably house one or more variable weight elements.

* * * * *